US005159730A

United States Patent [19]

Radvin

[11] Patent Number: 5,159,730

[45] Date of Patent: Nov. 3, 1992

[54] RESILIENT CLIP

[75] Inventor: Bill Radvin, Olivette, Mo.

[73] Assignee: Clipps, Inc., Evansville, Ind.

[21] Appl. No.: 780,421

[22] Filed: Oct. 22, 1991

Related U.S. Application Data

[63] Continuation of Ser. No. 619,249, Nov. 28, 1990, abandoned.

[51] Int. Cl.[5] ..... A44B 21/00

[52] U.S. Cl. ..... 24/543; 24/557

[58] Field of Search ..... 24/545, 555, 563, 543, 24/67.9, 487, 542, 518, 557, 565

[56] References Cited

U.S. PATENT DOCUMENTS

| | | | |
|---|---|---|---|
| 3,604,071 | 9/1971 | Reimels | 24/543 X |
| 3,982,307 | 9/1976 | Smith et al. | 24/543 |
| 4,807,334 | 2/1989 | Blanchard | 24/543 X |
| 4,835,824 | 6/1989 | Durham et al. | 24/543 X |

*Primary Examiner*—James R. Brittain

*Attorney, Agent, or Firm*—Haverstock, Garrett & Roberts

[57] ABSTRACT

A clip is disclosed which comprises a body including two opposing members having opposite end portions associated respectively therewith and an arcuate portion joining the two opposing members adjacent one of said opposite end portions at their ends, each of the opposing members having opposed jaw portions at the end portions opposite the arcuate portion, and arms on respective opposing members for locking the opposing members together, the locking means positioned intermediate the opposite end portions of the opposing members. The clip also comprises projections on respective opposing members opposite the arms for urging the arms into engagement and disengagement.

13 Claims, 2 Drawing Sheets

RESILIENT CLIP

This is a continuation of copending application Ser. No. 07/619,249 filed on Nov. 28, 1990, abandoned.

BACKGROUND OF THE INVENTION

The present invention relates to a clip and more particularly to a clip capable of holding an article, such as an article of clothing, without damaging the article.

Drycleaners are faced with the problem of how to secure articles of clothing or garments such as pants or skirts to hangers after the garments have been cleaned and pressed. Typically, pins or metal clips are used to secure the garments. Although pins or metal clips function to keep the garments in place they have a tendency to damage the garments due to their pointy or sharp ends. The metal clips are generally U-shaped and have pointy teeth at their ends which dig into the garment. If care is not exercised in attaching and removing the metal clips considerable damage may occur to the garment. Pins have pointed tips which can also damage the garment if care is not exercised in inserting and removing the pin. Therefore there is a need to provide a device to secure garments to hangers which does not damage the garment.

The closest known prior art to the present device is the identification card holder disclosed in Faneuf, U.S. Pat. No. 4,277,863. This prior art device includes two stiff members joined together by a flexible web forming a hinge. The web is intermediate the two stiff members. Opposed jaw portions are on respective members on one side of the hinge. On the other side of the hinge on one member is a spring finger which is biased against the other member to hold the jaws closed. The spring finger forms a loop for placing on it an identification card or badge. Use of this identification card holder is unsatisfactory as a clip for securing garments because it does not lock the jaws in place to secure the garment. The Fanuef device is also unacceptable because the jaws cannot be opened wide enough to accept thick garments. The construction of the Faneuf device also makes it difficult to place it on the rod of a hanger.

SUMMARY OF THE INVENTION

The present device, by contrast, is a clip which comprises a body including two opposing members having opposite end portions associated respectively therewith and an arcuate portion joining the two opposing members adjacent one of said opposite end portions at their ends, each of the opposing members having opposed jaw portions at the end portions opposite the arcuate portion, and means on respective opposing members for locking the opposing members together, the locking means positioned intermediate the opposite end portions of said opposing members. The locking means are positioned intermediate the opposing members. The clip also comprises means on respective opposing members opposite the arms for urging the locking means into engagement and disengagement. The jaw portions comprise means for gripping an article of clothing placed therebetween.

It is therefore a principle object of the invention to provide an improved clip for use in securing an article of clothing without damaging the article of clothing.

Another object is to provide an improved clip for use in securing an article of clothing to a hanger without damaging the article of clothing.

Another object is to provide an improved clip which does not have metal teeth or pointy ends which could damage an article of clothing.

Another object is to provide an improved clip which is easy to manufacture and simple to use.

These and other objects and advantages of the present invention will become apparent after considering the following detailed specification in conjunction with the accompanying drawings.

DETAILED DESCRIPTION OF THE PREFERRED EMBODIMENTS

Figure 1:
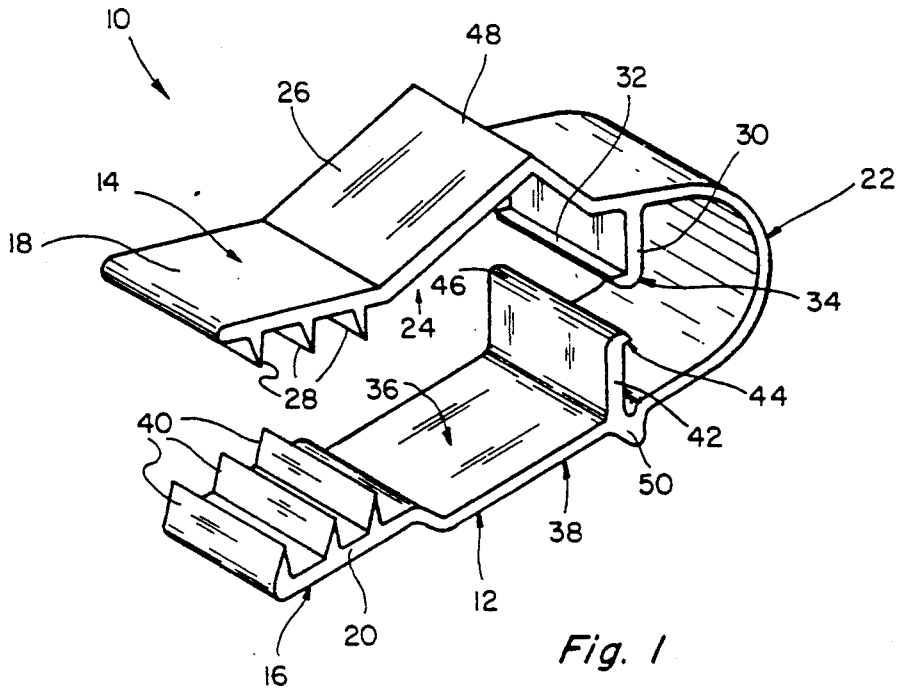
FIG. 1 is a perspective view of a clip of the present invention.

Referring now to the drawings more particularly by reference numbers, wherein like numbers refer to like items throughout the various drawings, numeral 10 refers to a clip of the present invention. As shown in FIG. 1, the clip 10 comprises a unitary body 12 which is generally U-shaped. The clip 10 is molded or extruded of plastic. The body 12 has two opposing members 14 and 16 having opposite end portions associated respectively therewith. Each of the opposing members 14 and 16 have an opposing jaw portion 18 and 20, respectively. The members 14 and 16 are connected together by a flexible arcuate portion 22 with the members 14 and 16 and the arcuate portion 22 forming the generally U-shaped body 12.

The member 14 has an interior surface 24 and an exterior surface 26. A portion of the interior surface 24 has rows of projections or teeth 28 adjacent to the opposing jaw portion 18. The interior surface 24 also includes an arm or hook 30 positioned intermediate the member 14 and extending inwardly from the interior surface 24 towards the member 16. The arm 30 is generally J-shaped and has a mating surface 32 at a distal end 34 of the arm 30.

Figure 4:
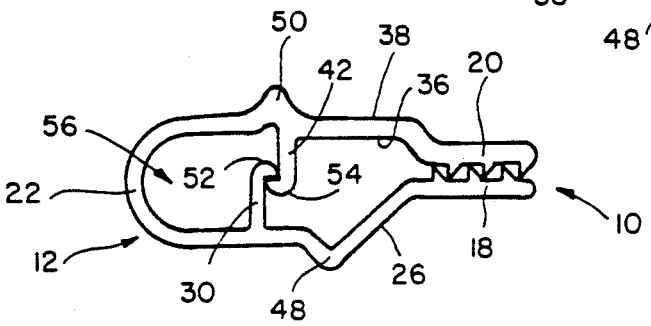
FIG. 4 is a side view of the clip shown in FIG. 2 with the clip in its closed position.

The member 16 has an interior surface 36 and an exterior surface 38. A portion of the interior surface 36 has rows of projections or teeth 40 adjacent to the opposing jaw portion 20. The teeth 40 alternate with the teeth 28 so that when the clip 10 is closed, and no article is between the teeth 28 and 40 as shown in FIG. 4, the teeth 28 and 40 are able to mesh together. The interior surface 36 also includes an arm or hook 42 positioned intermediate the member 16 and extending out from the interior surface 36 towards the member 14. The arm 42 is generally J-shaped and has a mating surface 44 at a distal end 46 of the arm 42. The mating surface 44 is adapted to mate or lock with the other mating surface 32 of the arm 30 when the arms 30 and 42 are hooked together.

The exterior surface 26 of member 14 includes a projection 48 which serves as a finger grip surface. The projection 48 is located between the jaw portion 18 and the arm 32. The exterior surface 30 of member 16 includes another projection 50 which serves as a finger stop. The projection 50 is located between the arm 42 and the arcuate portion 22.

Figure 2:
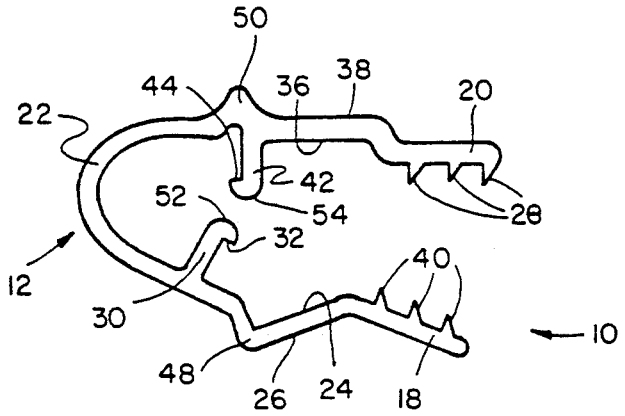
FIG. 2 is a reduced side view of the clip shown in FIG. 1 with the clip in its opened position.

Referring now to FIG. 2, the clip 10 is shown in an open position. The arcuate portion 22 biases the opposing members 14 and 16 apart. Both the arms 30 and 42 and the jaws 18 and 20 are also shown apart. In this open position, the arms 30 and 42 are spread far enough apart to allow a rod of a hanger to pass between to place the clip 10 on the rod.

Figure 3:
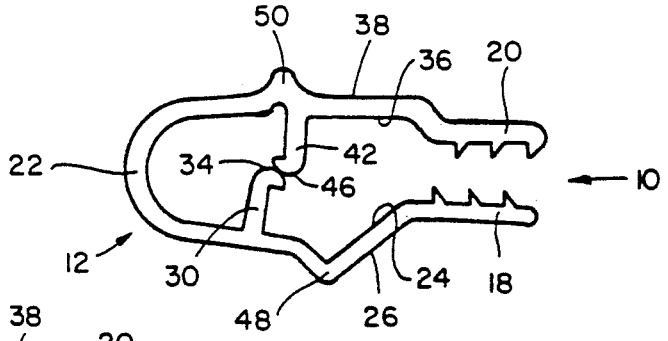
FIG. 3 is a side view of the clip shown in FIG. 2 with the clip in its partially closed position.

FIG. 3 illustrates the clip 10 in a partially closed position. The distal ends 34 and 46 of the arms 30 and 42 have come into contact with each other and the jaws portions 18 and 20 have not yet contacted each other. Outer curved surfaces 52 and 54 of the arms 30 and 42, respectively, contact each other and slide against each other until the mating surfaces 32 and 44 are able to contact each other to lock the arms 30 and 42 together.

The clip 10 is shown in a closed position in FIG. 4. The mating surfaces 32 and 44 of the arms 30 and 42 are contacting each other which serves to lock the opposing members 14 and 16 together. The rows of teeth 28 and 40 are also shown meshed together although when an article, such as an article of clothing, is between the teeth 28 and 40, the teeth 28 and 40 may not be able to mesh together. An area 56 defined and bounded by the arcuate portion 22 and the locked arms 30 and 42 is adapted to hold and retain a rod of a hanger as shown in FIG. 5.

In order to close the clip 10 and to lock it the projections 48 and 50 are squeezed together to urge the arms 30 and 42 together until the distal ends 34 and 46 have locked. The arms 30 and 42 are locked when the mating surfaces 32 and 44 are contacting each other. When the clip 10 is closed the teeth 28 and 40 are able to grasp and hold an article of clothing placed therebetween.

Figure 5:
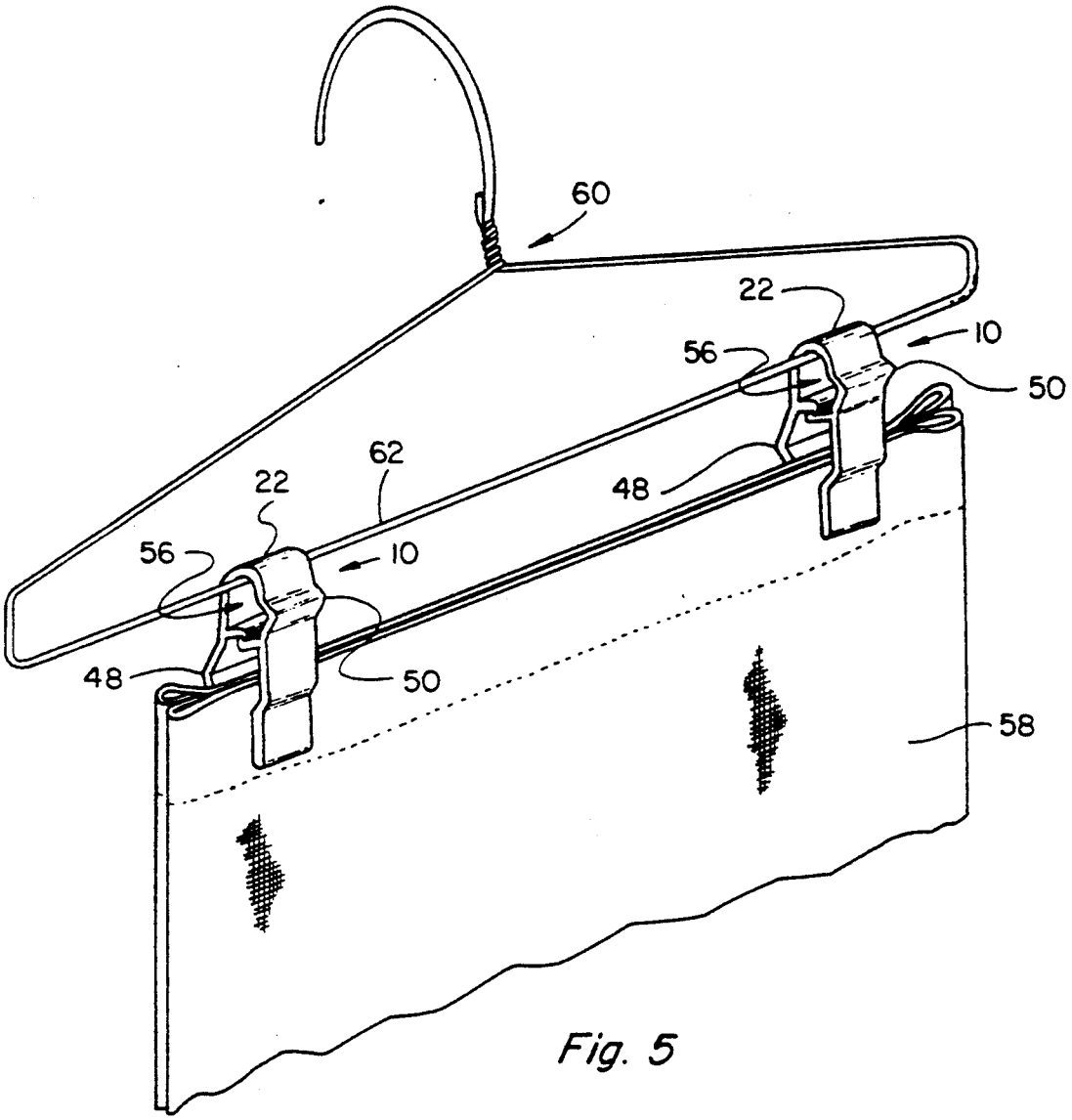
FIG. 5 is a perspective view of the clip of the present invention on a hanger secured to an article of clothing.

In FIG. 5 a pair of clips 10 are shown securing a garment 58 to a conventional hanger 56. The jaws 18 and 20 of the clip 10 are closed to grasp and hold the garment 54 and the arms 30 and 42 are hooked to lock the members 14 and 16 together. The area 56 defined and bounded between the arcuate portion 22 and the locked arms 30 and 42 is holding and retaining a rod 62 of the hanger 60. The rod 62 passes through the space between the arms 30 and 42 when the clip 10 is in the open position as shown in FIG. 2. Although only a pair of clips 10 are shown in FIG. 5 holding and retaining the garment 58 to the hanger 60, it is also possible to use one or more than two clips 10 to hold and retain the garment 58 to the hanger 60.

In order to open the clip 10 the projections 48 and 50 are squeezed together to slide the mating surfaces 32 and 44 of the arms 30 and 42 away from each other until the distal ends 34 and 46 are disconnected. Once disconnected, the bias of the arcuate portion 22 opens the jaw portions 18 and 20 to release the garment 58. Once the garment 58 is released the clip 10 may be removed from the rod 62 of the hanger 60 by sliding the rod 62 through the space between the distal ends 34 and 46 of the arms 30 and 42.

Figure 6:
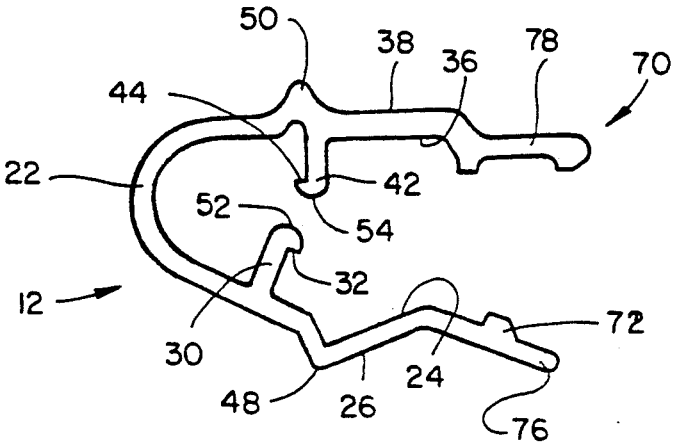
FIG. 6 is a side view of a second embodiment of a clip of the present invention.

FIG. 6 illustrates a second embodiment of a clip 70 of the present invention. The clip 70 is similar to the clip 10 with primary differences being the teeth 72 and 74 adjacent to the jaw portions 76 and 78, respectively. Tooth 72 is a single tooth and teeth 74 are two rows of teeth. Tooth 72 is positioned to fit between the two rows of teeth 74 when the clip 70 is in a closed position. The other parts of clip 70 are similar to clip 10 and have been similarly numbered. Clip 70 functions in much the same manner as clip 10. For example, in order to close the clip 70 and to lock it the projections 48 and 50 are squeezed together to urge the arms 30 and 42 together until the distal ends 34 and 46 have locked. The arms 30 and 42 are locked when the mating surfaces 32 and 44 are contacting each other. When the clip 70 is closed the teeth 72 and 74 are able to grasp and hold an article of clothing placed therebetween.

Additionally, in order to open the clip 70 the projections 48 and 50 are squeezed together to slide the mating surfaces 32 and 44 of the arms 30 and 42 away from each other until the distal ends 34 and 46 are disconnected. Once disconnected, the bias of the arcuate portion 22 opens the jaw portions 76 and 78 to release the garment 58. Once the garment 58 is released the clip 70 may be removed from the rod 62 of the hanger 60 by sliding the rod 62 through the space between the distal ends 34 and 46 of the arms 30 and 42.

Although it has been shown that either clip 10 or clip 70 may be used in combination with a hanger to secure clothing to the hanger, it is also contemplated that the clips 10 and 70 may be used to secure other articles such as papers or cardboard, and the clip does not have to be used in combination with a hanger.

Thus there has been shown and described several embodiments of novel clips which embodiments fulfill all of the objects and advantages sought therefor. It will be apparent to those skilled in the art, however, that many changes, modifications, variations, and other uses and applications for the subject device are possible. All such changes, modifications, variations and other uses and applications which do not depart from the spirit and scope of the invention are deemed to be covered by the invention which is limited only by the claims which follow.

What is claimed is:

1. A clip comprising:

a body including two opposing members having opposite end portions associated respectively therewith and an arcuate portion joining the two opposing members adjacent one of said opposite end portions at their sides;

each of the opposing members having opposed jaw portions at the end portions opposite the arcuate portion and each of the opposing members having an interior surface and an exterior surface;

a first locking arm extending inwardly from the interior surface of the opposing members;

a second locking arm extending inwardly from the interior surface of the other opposing member;

a first projection located on the exterior surface of one of the opposing members and located between the first locking arm and one of the jaws, the first projection having a first surface against which a finger of an operator is positioned in which to lock the locking arms and a second surface against which the finger of the operator is repositioned to unlock the locking arms, the exterior surface of one of the opposing members from the first locking arm opposite from the first projection being generally smooth and planar; and a second projection located on the exterior surface of the other one of the opposing members and located between the second locking arm and the arcuate portion, the second projection having a first surface against which a second finger of the operator is positioned in which to lock the locking arms and a second surface against which the second finger of the operator is repositioned to unlock the locking arms, the exterior surface of the other one of the opposing members from the second locking arm opposite from the second projection being generally smooth and planar.

2. The clip of claim 1 wherein the jaw portions comprise means for gripping an article of clothing placed therebetween.

3. The clip of claim 2 wherein the gripping means comprises rows of teeth on each of the jaw portions.

4. The clip of claim 1 wherein the arcuate portion and the first and second locking arms define a space adapted to hold and retain a rod of a hanger when the first and second locking arms are locked together.

5. The clip of claim 1 wherein the second surface of the first projection is inclined upwardly and the first surface of the first projection is inclined downwardly from the second surface.

6. The clip of claim 1 wherein the first and second locking arms are generally J-shaped and each have a mating surface at a distal end of each of the locking arms with the mating surfaces adapted to mate with each other when the first and second locking arms are hooked together.

7. A clip comprising:

a U-shaped member having opposed jaw portions on respective surfaces of the U-shaped member and a first exterior surface and a second exterior surface;

a first locking member on an interior surface adjacent to one of the jaw portions;

a second locking member on an interior surface adjacent to the other of the jaw portions, the first and second locking members being resiliently biased into locking engagement with each other so as to hold the jaw portions closed about an article;

a first projection on the first exterior surface on the U-shaped member located completely between the first locking member and one of the jaw portions, the first projection having a first surface against which a finger of an operator is positioned in which to engage the locking members and a second surface against which the finger of the operator is repositioned to disengage the locking members, the first exterior surface extending from the first locking member opposite from the first projection being generally smooth and planer; and a second projection on the second exterior surface of the U-shaped member located between the second locking member and the arcuate portion, the second projection having a first surface against which a second finger of the operator is positioned in which to engage the locking members and a second surface against which the second finger of the operator is repositioned to disengage the locking member, the second exterior surface extending from the second locking member opposite from the second projection being generally smooth and planar.

8. The clip of claim 7 wherein the second surface of the first projection is inclined upwardly and the first surface of the first projection is inclined downwardly from the second surface.

9. The clip of claim 7 wherein the first and second locking members are generally J-shaped and each have a mating surface at a distal end of each of the locking members with the mating surfaces adapted to mate with each other when the first and second locking members are hooked together when the operator places a finger on the first surface of the first projection and a second finger of the first surface of the second projection.

10. The clip of claim 7 wherein the jaw portions comprises rows of teeth on each of the jaw portions.

11. A clip comprising:

a body including two opposing members having opposite end portions associated respectively therewith and an arcuate portion joining the two opposing members adjacent one of said opposite end portions at their sides;

each of the opposing members having opposed jaw portions at the end portions opposite the arcuate portion and each of the opposing members having an interior surface and an exterior surface;

a first locking arm extending inwardly from the interior surface of one of the opposing members;

a second locking arm extending inwardly from the interior surface of the other opposing member;

a first projection located at a first position on the exterior surface of one of the opposing members and located between the first locking arm and one of the jaws, the exterior surface of one of the opposing members extending from the first locking arm opposite from the first projection being generally smooth and planar; and a second projection located at a second position on the exterior surface of the other one of the opposing members and located between the second locking arm and the arcuate portion, the first position being at a different location than the second position with respect to the arcuate portion, the exterior surface of the other one of the opposing members extending from the second locking arm opposite from the second projection being generally smooth and planar.

12. The clip of claim 11 wherein the first projection further comprises a first surface against which a finger of an operator is positioned in which to lock the locking arms and a second surface against which the finger of the operator is repositioned to unlock the locking arms.

13. The clip of claim 12 wherein the second projection further comprises a first surface against which a second finger of the operator is positioned in which to lock the locking arms and a second surface against which the second finger of the operator is repositioned to unlock the locking arms.

* * * * *